United States Patent [19]

Nomura

[11] 4,370,069

[45] Jan. 25, 1983

[54] ELECTRONIC ALARM TIMEPIECE

[75] Inventor: Hiroaki Nomura, Suwa, Japan

[73] Assignee: Kabushiki Kaisha Suwa Seikosha, Tokyo, Japan

[21] Appl. No.: 172,116

[22] Filed: Jul. 25, 1980

Related U.S. Application Data

[63] Continuation-in-part of Ser. No. 927,308, Jul. 24, 1978, abandoned.

[30] Foreign Application Priority Data

Jul. 22, 1977 [JP] Japan ..... 52-88093
Jul. 22, 1977 [JP] Japan ..... 52-88094

[51] Int. Cl.[3] ..... G04B 21/00; G10H 1/02
[52] U.S. Cl. ..... 368/273; 84/1.26
[58] Field of Search ..... 368/63, 72–75, 368/250, 251, 272, 273; 84/1.01, 1.03, 1.26; 340/384 E

[56] References Cited

U.S. PATENT DOCUMENTS

| | | | |
|---|---|---|---|
| 3,878,750 | 4/1975 | Kapps | 84/1.01 |
| 4,073,133 | 2/1978 | Earls et al. | 368/273 |
| 4,083,286 | 4/1978 | Faulkner | 84/1.26 |
| 4,090,349 | 5/1978 | Takase | 84/1.01 X |
| 4,098,071 | 7/1978 | Kawakami et al. | 368/73 |
| 4,140,039 | 2/1979 | Faulkner | 84/1.03 |
| 4,267,586 | 5/1981 | Uchino et al. | 368/272 |
| 4,271,495 | 6/1981 | Scherzinger et al. | 368/75 |
| 4,282,593 | 8/1981 | Flaig et al. | 368/63 |
| 4,328,731 | 5/1982 | Gotho | 84/1.26 |

*Primary Examiner*—Vit W. Miska
*Attorney, Agent, or Firm*—Blum, Kaplan, Friedman, Silberman & Beran

[57] ABSTRACT

An electronic timepiece has an alarm function using circuitry and an electroacoustic transducer to generate a selected melody. The frequencies of the generated tones lie close to those of the standard chromatic or diatonic scales, and are produced by dividing the frequency of a time-standard signal. A plurality of notes can be generated.

13 Claims, 11 Drawing Figures

FIG. 6a
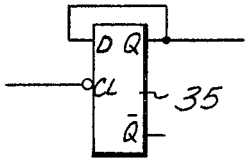
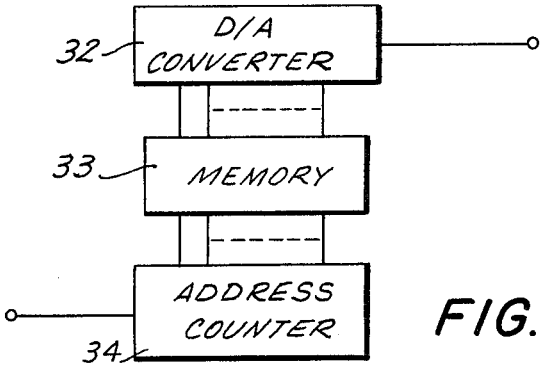
FIG. 6c
FIG. 6b
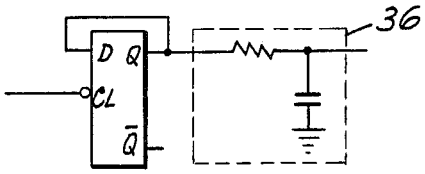
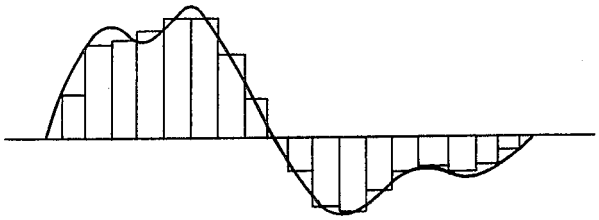
FIG. 6d

ELECTRONIC ALARM TIMEPIECE

This application is a continuation-in-part of application Ser. No. 927,308, filed July 24, 1978 for ELECTRONIC ALARM WRISTWATCH, now abandoned.

BACKGROUND OF THE INVENTION

Electronic alarm wristwatches and timepieces are known, the alarm function using an oscillator which outputs a timestandard high-frequency signal in the same way as does the oscillator used for generating timekeeping signals of hours, minutes and seconds. The alarm circuit includes a detector which detects coicidence between the alarm circuit and the time display circuit, at which point a buzzer or speaker of some type is activated. However, conventional electronic alarm wristwatches have thus far been capable only of producing a single note or, rather, a single tonal frequency. The capacity to generate a plurality of notes, especially where these notes lie close to the frequencies of the standard diatonic or chromatic scales has not as yet been available. The present invention is designed to provide this capacity.

SUMMARY OF THE INVENTION

An electronic alarm timepiece in accordance with the present invention includes conventional circuitry for displaying the time in hours and minutes and, preferably, in seconds, and also includes conventional components for generating an alarm at a preset time. These conventional components include an oscillator for generating a time-standard, high-frequency signal, divider means, detector means for determining when coincidence occurs between the alarm circuit set time and present time, the detector means being connected to driver means and an electroacoustic transducer which are activated when coincidence is detected. In addition, the timepiece of the present invention includes a programmable counter which provides a divided frequency corresponding to a musical note by appropriately dividing the output signals from the oscillator and divider means. The alarm circuit further includes a memory circuit in which an arbitrarily-selected melody is stored. Each address of the memory circuit stores signals which determine the sequence, pitch and duration of the notes produced.

Where a diatonic scale is desired, the oscillator provides one or both of the frequencies 32768 or 65536 Hz. Where a chromatic scale is desired, the oscillator generates one or both of the frequencies 65536 and 131072 Hz.

While the circuitry for generating an alarm in the form of a melody may be used in a variety of electronic devices, the preferred use is in an electronic wristwatch.

Accordingly, an object of the present invention is an improved electronic circuit capable of producing an alarm in the form of a melody.

Another object of the present invention is an improved electronic circuit capable of producing an alarm in the form of a melody in a diatonic scale.

A further object of the present invention is an improved electronic circuit capable of producing an alarm in the form of a melody in a chromatic scale.

An important object of the present invention is an improved electronic timepiece having an alarm capability where the alarm is in the form of a melody.

A significant object of the present invention is an improved electronic wristwatch having the capability of an alarm where the alarm is in the form of a melody.

A still further object of the present invention is an improved electronic timepiece capable of generating an alarm in the form of a melody, a plurality of notes being played simultaneously.

Another object of the present invention is an improved electronic timepiece with an alarm sound of controlled overtone content.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 6*a* and 6*b* are circuits for producing waveforms of FIGS. 5*a, b* and *c;*

FIG. 6*c* functionally indicates an envelope producing circuit; and

FIG. 6*d* is a signal envelope produced by the circuit of FIG. 6*c*.

DESCRIPTION OF THE PREFERRED EMBODIMENTS

Figure 1:
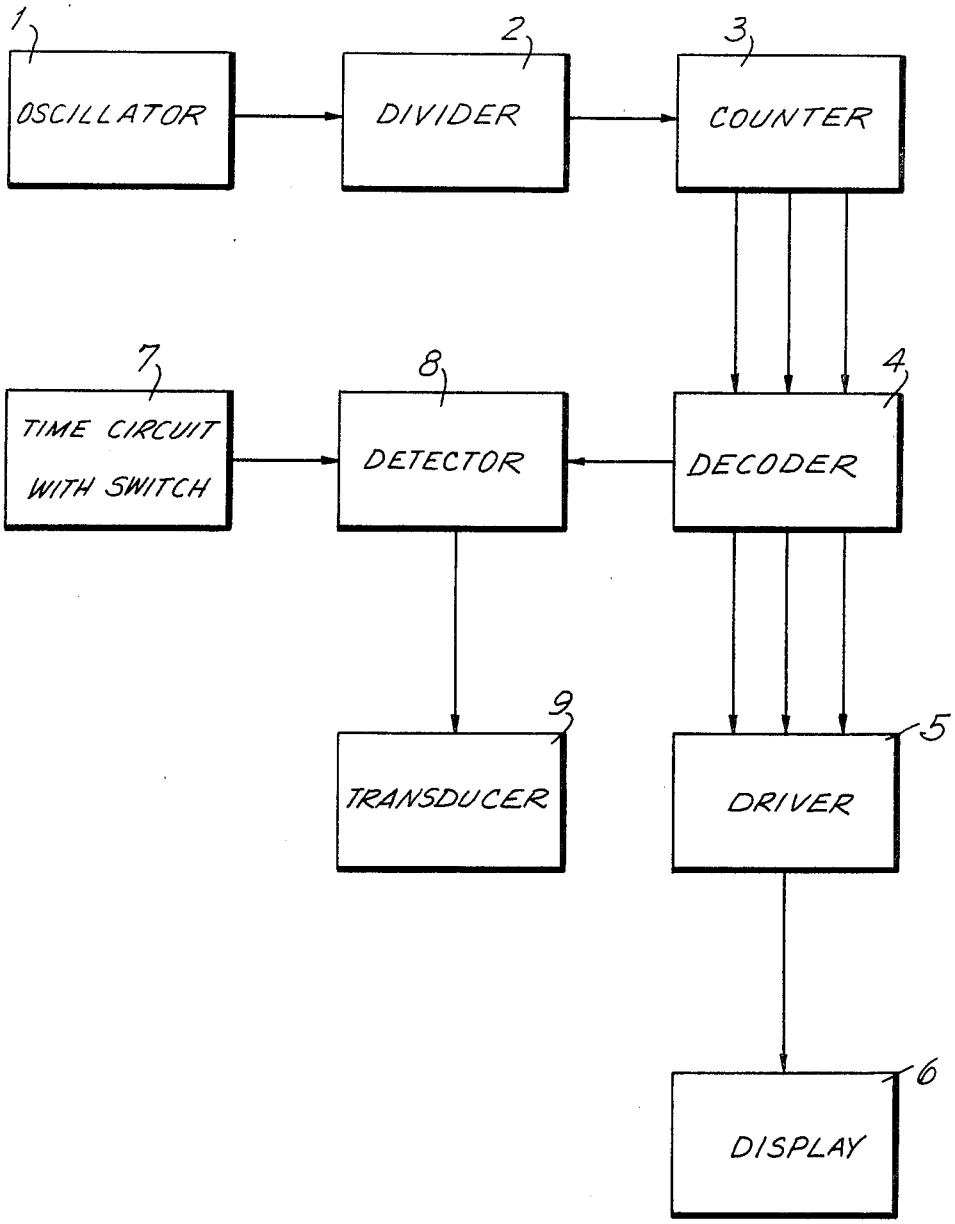
FIG. 1 PRIOR ART
FIG. 1 is a functional block diagram of a conventional electronic alarm wristwatch.

The circuitry of a conventional alarm wristwatch is shown in FIG. 1 in block diagram form. As is well known, the circuitry includes an oscillator circuit 1 using a quartz crystal vibrator. The oscillator circuit 1 generates a frequency signal which is a convenient power of two, the frequencies 32768 Hz, 65536 Hz and 131072 Hz, ordinarily being used for timepieces. The output of the oscillator circuit 1 is inputted to a divider circuit 2 comprising more than ten stages and the frequency is successively reduced by one-half in each stage. The divider circuit 2 ultimately produces a signal of 1 Hz. This signal is sexagesimalized or duodecimalized in a counter circuit 3 to produce signals corresponding to hours, minutes and seconds. These signals are then transformed into segment signals by a decoder 4, input to a driver 5 and then to a display means 6 which may be a liquid crystal display device or other electro-optical device.

For generating an alarm, a time circuit 7 is provided which includes a switch which is accessible from the exterior of the watch. The input signal is transformed directly into a binary signal and sent to a detector circuit 8. When coincidence is detected between the preset alarm time of the time-setting circuit 7 and present time in the decoder 4, a signal from the detector 8 is converted into a buzzer sound by an electroacoustic transducer 9, the buzzer serving as the alarm. As is evident, such a buzzer can produce only a single tone and so, while functional, can be unpleasant and lacking in interest and attractiveness.

Circuitry in accordance with the present invention makes it possible to generate an attractive and pleasant melody. The circuit is exemplified in FIG. 2 in block diagram form.

In order to produce a melody, the frequencies of the notes produced must lie close to those of an accepted scale. In our culture, the most commonly-accepted scales are the diatonic and the chromatic scales. However, it is to be recognized that other cultures find other scales pleasant to the ear; the present invention, as will become evident, can be adapted for the production of notes falling on or close to the notes of any desired or selected scale.

The basis selected for producing a scale in accordance with the present invention is the octave interval between successive C's. Thus, table A shows in the column headed "note" the designation of the notes in two octaves of the internationally-agreed-on scale, and in the second column of table A the frequencies of the notes.

The frequency 1047 Hz for the note $C_6$ cannot be exactly achieved by dividing any of the standard frequencies used in a timepiece oscillator by a whole number. However, if the standard frequency of 32768 Hz is divided by 32, a frequency of 1024 Hz results. This frequency is quite close to the international frequency for $C_6$ and is conveniently taken as the basis for a scale. For the intervals between the successive notes to be the same as those in the international scale, the frequencies of the successive notes should be those given in the third column of Table A, the Table being headed "frequency optimal for timepiece".

TABLE A

| 1 | 2 | 3 | Column 4 | 5 | 6 | 7 |
|---|---|---|---|---|---|---|
| | frequency (Hz) | | | | | |
| Note ↓ | international agreement | optimal for timepiece | Actual divided frequency (Hz) | dividing ratio: standard frequency 32,768 Hz | dividing ratio: standard frequency 65,536 Hz | error (Hz) |
| $C_6$ | 1047 | 1024 | 1024 | 32 | 64 | 0 |
| D | 1175 | 1149 | 1130 | 29 | 58 | +19 |
| E | 1319 | 1290 | 1260 | 26 | 52 | −30 |
| F | 1398 | 1366 | 1365 | 24 | 48 | −1 |
| G | 1569 | 1534 | 1560 | 21 | 42 | +26 |
| A | 1761 | 1721 | 1725 | 19 | 38 | +4 |
| B | 1976 | 1932 | 1928 | 17 | 34 | −4 |
| $C_7$ | 2094 | 2048 | 2048 | 16 | 32 | 0 |
| D | 2350 | 2299 | 2260 | — | 29 | −39 |
| E | 2638 | 2580 | 2521 | — | 26 | −59 |
| F | 2795 | 2734 | 2731 | — | 24 | −3 |
| G | 3137 | 3069 | 3121 | — | 21 | +52 |
| A | 3522 | 3444 | 3449 | — | 19 | +5 |
| B | 3953 | 3866 | 3855 | — | 17 | −11 |
| $C_8$ | 4188 | 4096 | 4096 | — | 16 | 0 |

With the exception of the values for $C_6$ and $C_7$, these frequencies cannot be exactly achieved by dividing the standard frequency by a whole number. However, when the standard frequencies (32,768 and 65,536) are divided by the whole numbers listed in the upper half of the fifth and sixth columns respectively, and headed "dividing ratio", signals with the frequencies shown in column four (actual divided frequency) are produced. The differences or errors between the "optimal" frequencies of column three, which are based on a frequency of 1024 for $C_6$, and the actual frequencies obtained by dividing a standard frequency by the whole numbers in columns five and six are shown in column seven. The values in column seven show the errors resulting from producing notes in this way. As will become evident, the error as measured in Hz is less than 1/6 of the interval between successive notes on the scale. This error is sufficiently small so that it is not usually detectable by the non-professional listener.

Notes in the scale from $C_7$ to $C_8$ are preferably obtained by dividing the standard frequency of 65536 Hz by the whole numbers listed in the bottom half of column 6 of Table A. In this case, the basis for the octave is a frequency of 2048 Hz for the note $C_7$. This note is obtained by dividing the standard oscillator frequency signal of 65,536 Hz by the whole number 32. The maximum error appears to be just twice as large as for the octave beginning with $C_6$. However, the interval between each of the successive notes is just twice as large, so that the relative error is of the same magnitude, namely, less than 1/6 of the interval between successive tones.

A chromatic scale can also be obtained in much the same way. Since the tonal intervals are one-half as great as in the case for a diatonic scale, it is preferable to use the frequencies 65536 Hz or 131072 Hz as the standard frequency. Table B shows the sequence of whole numbers by which the standard frequencies are divided to produce the desired notes. As before, a frequency of 1024 Hz is taken for representing $C_6$. This frequency is obtained by dividing the standard frequency 65536 Hz by 64. This frequency is close to the internationally-agreed-on value of $C_6$, namely 1047 Hz. The error for the various notes of the scale is found to be less than $\frac{1}{8}$ of the interval between successive notes. This error is generally undetectable by the non-professional.

As can be seen from the above, and as explained more fully hereinafter, by using the standard oscillator frequency for a timepiece as part of the alarm circuitry and dividing this frequency by selected whole numbers, it becomes possible to produce an alarm signal in the form of a melody through the use of an irreducible minimum of components and circuitry.

TABLE B

| 1 | 2 | 3 | Column 4 | 5 | 6 | 7 |
|---|---|---|---|---|---|---|
| | frequency (Hz) | | | | | |
| Note ↓ | international agreement | for timepiece | Actual divided frequency (Hz) | dividing ratio: standard frequency 65,536 Hz | dividing ratio: standard frequency 131,072 Hz | error (Hz) |
| $C_6$ | 1047 | 1024 | 1024 | 64 | 128 | 0 |
| C♯D♭ | 1109 | 1085 | 1092 | 60 | 120 | +7 |
| D | 1175 | 1149 | 1150 | 57 | 114 | +1 |
| D♯E♭ | 1245 | 1218 | 1214 | 54 | 108 | −4 |
| E | 1319 | 1290 | 1285 | 51 | 102 | −5 |
| F | 1398 | 1367 | 1365 | 48 | 96 | −2 |
| F♯G♭ | 1481 | 1448 | 1456 | 45 | 90 | +8 |
| G | 1569 | 1534 | 1524 | 43 | 86 | −10 |
| G♯A♭ | 1662 | 1625 | 1638 | 40 | 80 | +13 |
| A | 1761 | 1722 | 1725 | 38 | 76 | +3 |
| A♯B♭ | 1866 | 1825 | 1820 | 36 | 72 | −5 |
| B | 1976 | 1933 | 1928 | 34 | 68 | −5 |
| $C_7$ | 2094 | 2048 | 2048 | 32 | 64 | 0 |
| C♯D♭ | 2219 | 2170 | 2185 | — | 60 | +15 |
| D | 2350 | 2299 | 2300 | — | 57 | +1 |
| D♯E♭ | 2496 | 2435 | 2427 | — | 54 | −8 |

TABLE B-continued

| 1 | 2 | 3 | 4 | 5 | 6 | 7 |
|---|---|---|---|---|---|---|
| | Column | | | | | |
| | frequency (Hz) | | Actual | | | |
| | interna- | | divided | dividing ratio | | |
| Note ↓ | tional agree- ment | for time- piece | fre- quency (Hz) | standard frequency 65,536 Hz | standard frequency 131,072 Hz | error (Hz) |
| E | 2636 | 2580 | 2570 | — | 51 | −10 |
| F | 2795 | 2734 | 2731 | — | 48 | −3 |
| F#G♭ | 2961 | 2896 | 2913 | — | 45 | +17 |
| G | 3137 | 3069 | 3048 | — | 43 | −21 |
| G#A♭ | 3324 | 3251 | 3277 | — | 40 | +26 |
| A | 3522 | 3444 | 3449 | — | 38 | +5 |
| A#B♭ | 3731 | 3649 | 3641 | — | 36 | −8 |
| B | 3953 | 3866 | 3855 | — | 34 | −11 |
| $C_8$ | 4188 | 4096 | 4096 | — | 32 | 0 |

Figure 2:
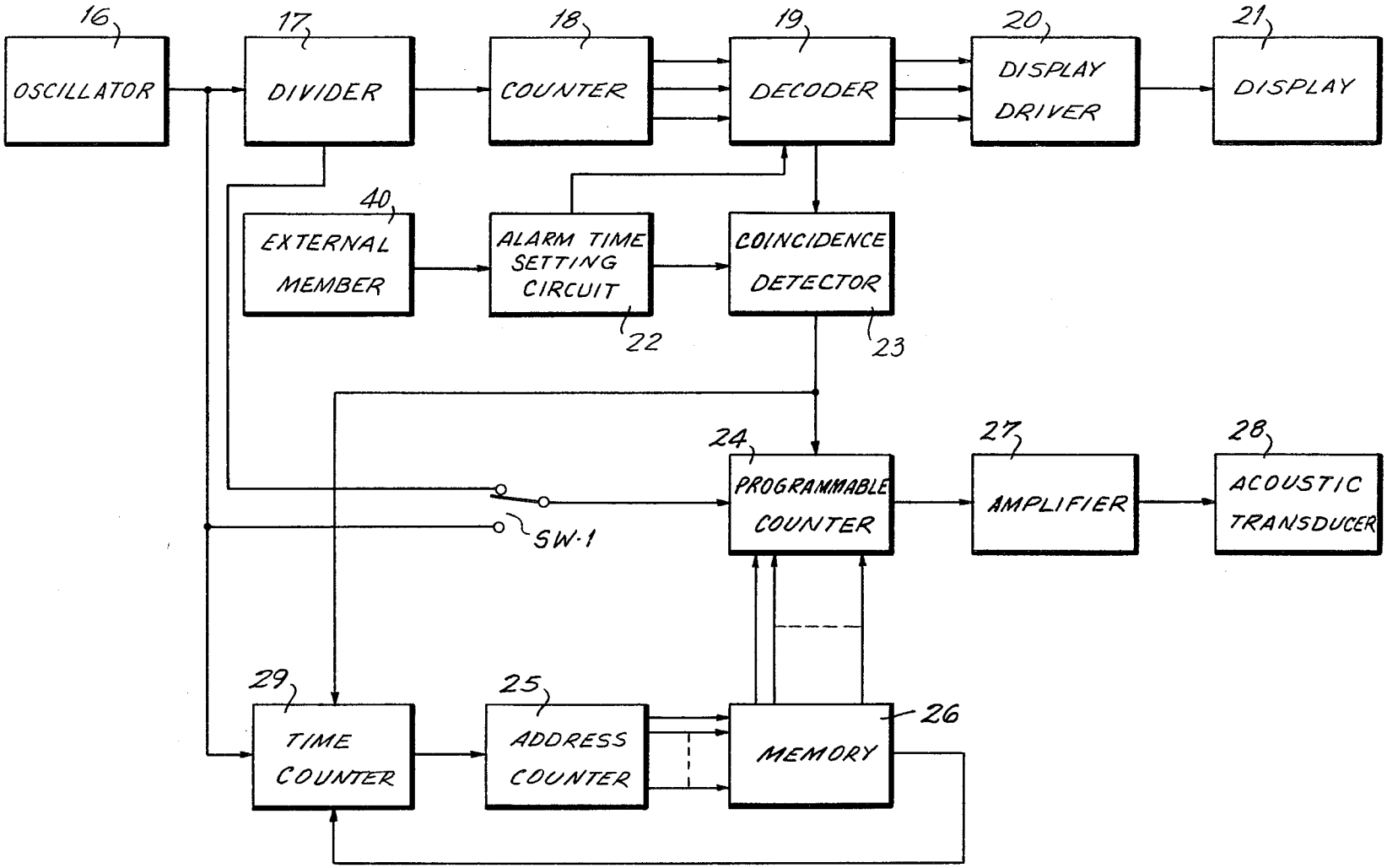
FIG. 2 is a functional block diagram of an electronic alarm timepiece in accordance with this invention for producing an alarm sound in the form of a melody.

An electronic timepiece in accordance with the present invention and incorporating the circuitry and components as aforenoted is shown in FIG. 2.

An oscillator circuit 16 outputs a single standard frequency signal, for examples, 65,536 Hz, 131,072 Hz. The principles of circuit operation are the same regardless of which oscillator frequency is used in the timepiece. The standard frequency signal from the oscillator circuit 16 is inputted to a divider circuit 17 which includes dozens of flip-flop stages, each stage outputting a signal having a frequency equal to ½ of the frequency of the input signal to that stage. The stages are connected in series and supply a counter 18 with a signal of 1 Hz.

In the known manner, the 1 Hz signals are accumulated in counter circuits 18 to produce hour, minute and second signals. The timekeeping signals from the counter circuits 18 are inputted through a decoder 19 which outputs signals to a display driver 20 which in turn drives the segments for a display 21, all in the known manner.

An alarm circuit is comprised of an acoustic transducer 28, for example, a loudspeaker, driven by an amplifier 27 having inputs from a programmable counter 24. The outputs of the counter 24 are controlled by a memory 26, as described more fully hereinafter.

A time for sounding the alarm is selected using an external member 40 which is associated with an alarm time-setting circuit 22. The selected alarm time can be displayed selectively on the display 21 through the decoder 19 and display driver 20. The condition of the alarm time-setting circuit is compared with the present time-keeping signals in the decoder 19 by means of a coincidence detector 23. When the data stored in the alarm time-setting circuit 22 coincides with the signals representing present time in the decoder 19, the coincidence detector 23 outputs a signal which sets a programmable counter 24 and a time counter 29. Thereby the alarm, comprising an audible melody, is initiated.

By means of an electronic switch SW-1, the programmable counter 24 is inputted with either of two signals. One signal which may be inputted to the programmable counter 24 comes directly from the oscillator 16 and the other signal which may be inputted to the programmable counter 24 is derived from the output of the first flip-flop stage of the divider circuits 17. The frequency out of the first stage of the divider circuit 17 is ½ of the frequency out of the oscillator circuit 16. The position of the switch SW-1 and the frequency inputted to the programmable counter 24 is controlled by the memory 26. The programmable counter 24 divides down the inputted frequency signal to provide output signals in the range of frequencies used as musical notes or tones as shown in Tables A and B. The dividing ratio within the programmable counter is varied in accordance with signals delivered from stored data in the memory 26. Each address in the memory holds data to produce at least a note of the melody. Using the standard frequency 32,768 Hz as an example (Table A), it can be seen that a dividing ratio in the programmable counter 24 of 32 will produce a note $C_6$ having a frequency of 1,024 Hz. A dividing ratio of 16 in the programmable counter 24 will produce with that input signal a note $C_7$ of 2,048 Hz. Thus, all the notes in a single octave can be produced from a standard input frequency of 32,768 Hz using a programmable counter having dividing ratios in the range of 16 to 32.

It can also be seen from Table A, that is the standard frequency input to the programmable counter 24 is 65,536 Hz and the programmable counter has the same range of dividing ratios, namely, a range of 16 to 32, then the output signals from the programmable counter 24 will correspond to the notes $C_7$ to $C_8$. These are, respectively, frequencies of 2,048 Hz and 4,096 Hz.

Further, it can be seen from Table A that using the same programmable counter 24 having dividing ratios in the range of 16 to 32, both octaves from $C_6$ to $C_8$ can be produced provided that a signal 32,768 Hz is first inputted to the programmable counter through switch SW-1 from the output of the first divider stage of divider 17. Then the notes from $C_7$ to $C_8$ can be produced when the switch SW-1 is in the other position so as to directly feed the signal of 65,536 Hz from the oscillator 16 to the programmable counter 24.

As a consequence, by changing over the switch SW-1, two octaves of notes are obtained when the dividing ratio of the programmable counter 24 is in the variable range of 16 to 32. It will also be apparent from Table B that two octaves of notes of a chromatic scale can be produced when the programmable counter 24 has a variable range of dividing ratios from 32 to 64 and the input frequencies are 65,536 Hz and 131,072 Hz.

It should be noted, that by means of the two frequencies and switch SW-1 for selecting between the two frequencies, the circuit construction of the programmable counter 24 is made much less complex as compared to a circuit using only a single frequency output from the oscillator 16. Specifically, two octaves of notes are provided using ½ of the range of dividing ratios in the programmable counter 24 when the switch SW-1 is utilized. If only the standard signal of 65,536 Hz from the oscillator 16 is used, two octaves of notes are obtainable with a variable range of dividing ratios in the programmable counter of 16 to 64. In the circuit as described above using the switch SW-1, the range is only 16 to 32. With reference to Table B, two octaves of notes, including chromatic notes, are obtained with a variable range of diving ratios in the programmable counter of 32 to 64 when the switch SW-1 is used. However, if omitting the switch SW-1 and using only an oscillator frequency of 131,072 Hz, a range of diving ratios in the programmable counter 24 of 32 to 128 is required. The advantage of using the switch in reducing the complexity of the programmable counter 24 is apparent. If not using the switch, it becomes unnecessary to provide a switch means and to let the memory have the function for controlling the switch means. Therefore, one method can be voluntarily selected between the two methods of obtaining standard frequency.

As stated above, the memory 26 stores data at each address which sets the dividing ratio of the programmable counter 24. Thereby the stored data in the memory produces a note, that is a selected frequency output, from the programmable counter which is fed to the amplifier 27 and then to the acoustic transducer 28. The memory address also contains data which is fed to a time counter 29. The standard frequency signal from the oscillator circuit 16 is inputted to the time counter 29 and divided down therein in a manner similar to the division which occurs in the programmable counter. A signal out of the time counter 29 is inputted to the address counter 25 which in turn advances the memory to the next address. Thereby the next note signals are outputted and the next note of a melody is reproduced at the acoustic transducer by way of the programmable counter 24 and amplifier 27. The signal from the memory address to the time counter 29 determines how many cycles of signal from the oscillator 16 at a high frequency are required to provide an output signal from the time counter 29. Because the memory address is advanced and another note is played every time the time counter 29 outputs a signal, the duration of the notes is varied in accordance with the signal from the memory 26 to the time counter 29. The memory 26 outputs its data to the programmable counter 24, so long as it is at the same address. When the time counter 29 advances the address counter 25 then one note is terminated and the next note is initiated. Accordingly, the memory 26 controls both the note frequency, that is, the note on the scale, and the duration of that note. In this way, a tempo is provided to the melody. All notes are not of the same duration.

Although the notes produced by the melody alarm of FIG. 2 have a melody with the desired rhythm, the audible sounds have a monotone quality. Hence, the music produced by the alarm is inferior to that produced by a mechanical tone generator of the type frequently incorporated in a music box. Nevertheless, as is apparent from the electronic circuitry depicted in FIG. 2, there are advantages to an electronic note generator in that there is a capability to store new musical information in the memory and thereby produce different tunes with changing rhythms and selected starting and stopping.

Figure 3:
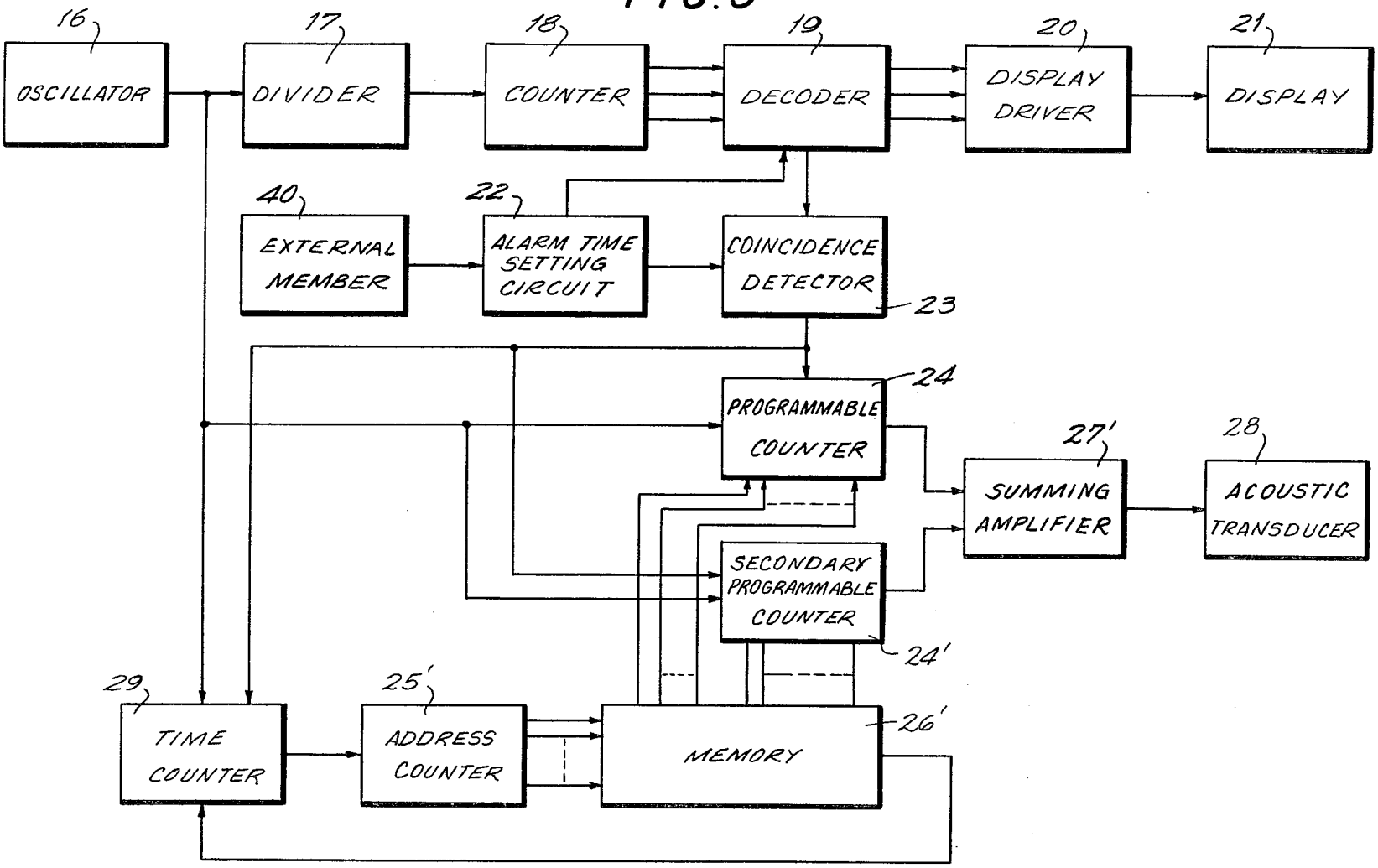
FIG. 3 is a functional block diagram of an alternative embodiment of an alarm timepiece in accordance with this invention.

Reference is now made to FIG. 3, wherein an alternative embodiment of an electronic tone generator circuit in accordance with this invention is depicted. Like reference numerals are utilized to denote like elements discussed above with reference to FIG. 2. A timekeeping and alarm generating circuit is comprised of an oscillator circuit 16 outputting standard frequency signals to a divider circuit 17, counter 18, decoder 19, display driver 20 and display 21. Also included are an alarm time-setting circuit 22 and coincidence detector 23. All of these circuits perform the same function in the same manner as described in relation to FIG. 2 for the purpose of displaying time-keeping functions and initiating an alarm signal.

A primary electronic note generating circuit is comprised of the oscillator 16, a programmable note counter 24, memory 26', address counter 25' and time counter 29. Each of these circuits operates in the same manner as their counterpart in FIG. 2 in order to produce a primary note signal representative of a primary melody.

Additionally, a secondary programmable note counter 24' is also coupled to the oscillator circuit 16 in order to produce a secondary note signal representative of a secondary melody. Data from the memory 26' is also inputted to the secondary programmable counter 24', such that each programmable counter 24, 24' receives new note data each time the address for reading of the memory 26' is advanced. As before, coincidence in the detector 23 between the alarm set time in the alarm setting circuit 22 and the present time indicated by data in the decoder 19 starts the alarm melodies. Further, at each address of the memory 26', data is inputted to the time counter 29 to determine the duration of the note which will be produced from each memory address. Now the note frequency signals from both programmable counters 24, 24' are inputted to a summing amplifier 27' where they are combined and the output of the amplifier 27' is inputted to the acoustic transducer 28. Thus, the tone generator circuits for the timepiece of FIG. 3 can produce a primary melody having accompaniment, obbligato and chords. Thus, a timepiece having such circuits for producing two notes simultaneously has a vastly improved sound quality. It should be apparent that the number of programmable counters controlled by a memory is not limited to one or two as shown in FIGS. 2 and 3, respectively.

Figure 4:
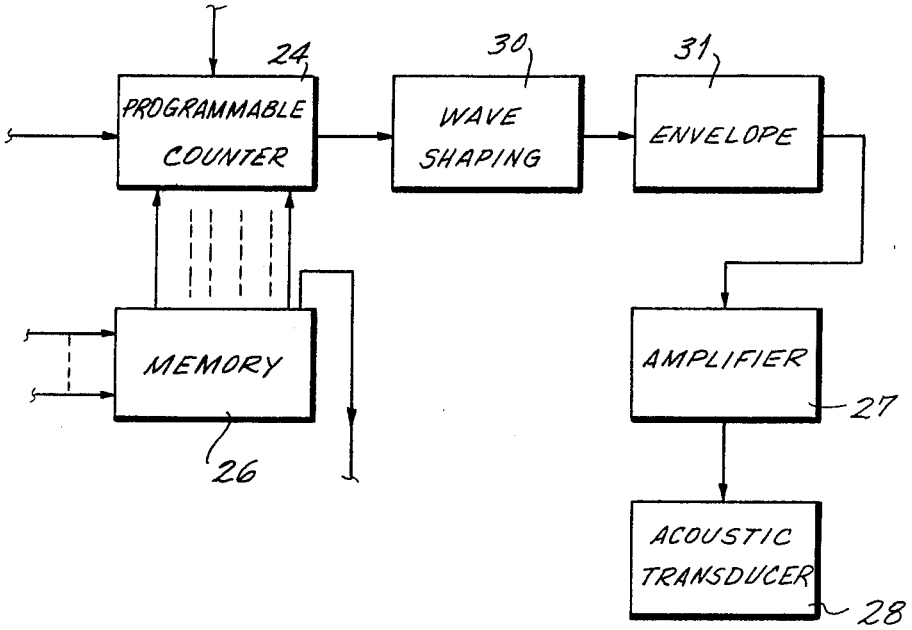
FIG. 4 is a partial functional block diagram of yet another alternative embodiment of an alarm timepiece in accordance with this invention.

Because of its small size, the alarm circuits in a wristwatch cannot have their sound quality greatly improved; however, for a larger timepiece, such as a table clock, improvements can be made in the sound quality. First, such an enlarged timepiece can have a much larger loudspeaker than a wristwatch. This alone can improve the tone quality. Also, the tonal qualities can also be improved as indicated in the partial circuit of FIG. 4 by coupling to the outputs of the programmable counter 24, 24' a wave shaping circuit 30 for shaping the primary note signals produced by the programmable counter 24. Similarly, a secondary wave shaping circuit 30' is coupled to the secondary prgrammable note counter 24' of the secondary electronic note generating circuit for shaping the note signals produced. The shaped signals respectively produced by the wave shapers, 30, 30' are then inputted to envelope forming circuits 31, 31', respectively, to thereby apply acoustic envelopes to the respective shaped signals inputted thereto. Finally, the shaped signals produced by the envelope circuits 31, 31' are applied to the summing amplifier circuit 27'. This circuit then sums and amplifies the respective signals and properly attenuates the signals so that a composite signal is applied to the electroacoustic transducer 28 and radiated as a musical sound.

It is noted that the envelope circuits 31, 31' are not essential, but are particularly suitable for generating a pleasing tone quality and represent one technique by which the wave form can be smoothed into a comfortable envelope prior to the signals being applied to the acoustic transducer.

Figure 5A:
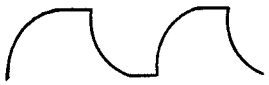
FIGS. 5*a, b* and *c* are waveforms of alarm signals produced by the circuit of FIG. 4.
Figure 5B:
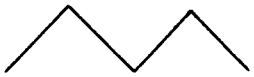
Figure 5C:
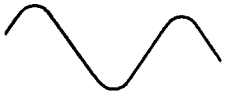

The wave shaping circuits 31, 31' have a significant influence in improving the quality of the music produced by the alarm circuits depicted in FIG. 3. When the counters 24, 24' produce rectangularly shaped wave forms, and high overtone components are desired in either the primary melody or the secondary notes, the respective wave shaping circuits can be eliminated. However, in order to effectively utilize the secondary notes as an accompaniment or the like, a note signal having less overtone components than a rectangular wave is desirable. Moreover, a pleasing result is obtained when a primary melody uses rectangular wave forms of high overtone content and the secondary melody has wave forms having less overtone components. FIGS. 5*a*, 5*b*, and 5*c* show wave forms having less overtone components than a rectangular wave form. These include sine waves, saw-tooth and tapered forms.

The circuits of FIGS. 6*a* and *b* are examples of circuits suitable for the wave shaping circuits 30, 30'. Specifically, a D-type flip-flop of the type depicted in FIG. 6*a*, will produce a rectangular wave. Accordingly, if the primary note signal, produced by the programmable counter 24 is to be maintained as a rectangular wave, the wave shaping circuit 30 can be comprised of such a D-type flip-flop. The flip-flop 35 is necessary because a signal produced by the programmable scale counter 24 is not suitable for producing a melodious tone. However, a flip-flop 35 divides the signal produced by the scale counter 24 by one-half to produce a rectangular wave having a one-half duty cycle. An this half duty cycle rectangular wave is then used to produce the primary melody.

By disposing a filter circuit 36 at the output of a flip-flop 35, as illustrated in FIG. 6*b*, the half duty cycle rectangular wave is modified to thereby eliminate the high overtones therefrom. Such a signal is suitable for accompanying the primary melody.

A wave shaping circuit (FIGS. 6*b*, 6*d*) is provided for dividing the note signal at specific time intervals. Data signals stored in a memory 33 represent peak values for each time interval and this data is read out of memory 33 into a digital-to-analog converter 32 which converts the digital data into an analog signal. The frequency with which the signals are read from the memory 33 to the digital to analog converter 32 is determined by an address counter 34 which uses pulses produced by the programmable counters 24, 24'. By this arrangement, it is possible to vary the frequency of the address counter 34 and produce a signal having any particular desired waveform, for example, sine, triangular, etc. Thus, the signals from the programmable counters 24, 24' are modified in wave shape and in amplitude. By altering the wave shape using a circuit as shown in FIG. 6*c*, sounds can be reproduced as though made by different musical instruments. The different instruments can represent the primary melody and an accompaniment melody.

It will thus be seen that the object set forth above, among those made apparent from the preceding description, are efficiently attained and, since certain changes may be made in the above constructions without departing from the spirit and scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece having oscillator means for generating a standard high frequency signal for timekeeping, a divider circuit receiving and dividing down said standard high frequency signal into lower frequency timekeeping signals, counter means for accumulating said lower frequency timekeeping signals in categories representative of time, said categories including at least hours and minutes, display means for visual presentation of timekeeping data, and means for driving said display, said counter means inputting time data signals to said means for driving, the improvement therein comprising:

a note producing circuit, said note producing circuit including a memory circuit for storing note and time duration data, at least one programmable counter means for automatically variably dividing pulses outputted by said oscillator means to produce in sequence difference notes of determined frequency in response to said data in said memory circuit;

circuit means for controlling the duration of each note, said circuit means for controlling duration including a time counter dividing down said standard signals from said oscillator means, the division ratio of said time counter being automatically variable in response to said time duration data stored in said memory;

an address counter receiving the output of said time counter and outputting a signal to said memory, said time counter output signal advancing the memory address, data for the next succesive note being input from said memory circuit to said programmable counter means;

an electro-acoustic transducer receiving the output of said note producing circuit and audibly outputting said sequence of notes to produce a special sound effect;

means to actuate said note producing circuit;

switch means for selectively connecting said first programmable counter means to said oscillator means directly or to a stage in said divider circuit, either of two frequencies being selectively inputted to said programmable counter means by operation of said switch means, said notes being produced in response to said data stored in said memory in two octave ranges.

2. An electronic timepiece as claimed in claim 1 wherein said special sound effect is a melody.

3. An electronic timpiece as claimed in claim 1, wherein said means to initiate operation of said note producing circuit includes alarm time setting means, said note production commencing at said set alarm time.

4. An electronic timepiece as claimed in claim 3, wherein said means for initiating production of said notes further include a coincidence detector, said coincidence detector comparing signals of present time from said means for driving said display with said time set in said alarm time setting circuit, coincidence of said signals causing said coincidence detector to initiate production of said notes in sequence.

5. An electronic timpiece as claimed in claim 1, wherein said switch produces notes in two adjacent octaves.

6. An electronic timepiece as claimed in claim 1, wherein said memory stores data to control said switch whereby one or the other octave scale is chosen for note production.

7. An electronic timepiece as claimed in claim 1, wherein said programmable counter means is constructed for dividing a high frequency signal by the set of integral numbers 64, 60, 57, 54, 51, 48, 45, 43, 40, 38, 36, 34 and 32 for producing notes within an octave of a chromatic scale and the frequency output of said oscillator means is approximately 65536 Hz.

8. An electronic timpiece as claimed in claim 1, wherein said programmable counter means is constructed for dividing a high frequency time standard signal by the set of integral numbers 64, 60, 57, 54, 51, 48, 45, 43, 40, 38, 36, 34 and 32 for producing notes within an octave of a chromatic scale and the frequency input of said oscillator means is approximately 131072 Hz.

9. An electronic timpiece as claimed in claim 1, wherein said programmable counter means is constructed for dividing a high frequency time standard signal by the set of integral numbers 32, 29, 26, 24, 21, 19, 17 and 16 for producing notes within an octave of a diatonic scale and the frequency output of said oscillator means is approximately 32,768 Hz.

10. An electronic timpiece as claimed in claim 1, wherein said programmable counter means is constructed for dividing said time standard signal by the set of integral numbers 32, 29, 26, 24, 21 19, 17 and 16 for producing notes within an octave of an diatonic scale and the frequency output of said oscillator means is approximately 65536 Hz.

11. An electronic timpiece as claimed in claim 1 and further comprising a wave shaping circuit in said note producing circuit, said wave shaping circuit receiving the output of said programmable counter means and being adapted to modify said signal output to provide periodic waves having a wave form selected from the group including rectangular, tapered sinusoidal and saw-tooth triangular wave forms.

12. An electronic timpiece as claimed in claim 11 wherein said wave shaping circuits superimposes an amplitude modulating envelope on the signal from said programmable counter means.

13. An electronic timpiece as claimed in claim 1, and further comprising means to amplify note waveforms produced by said note-producing circuit, said means to amplify receiving the output of said note-producing circuit and inputting an amplified signal to said electro-acoustic transducer.

* * * * *